US006216694B1

(12) United States Patent
Chen

(10) Patent No.: US 6,216,694 B1
(45) Date of Patent: Apr. 17, 2001

(54) STUFF-IN TYPE NOSE PLUG WITH AIR FILTERS

(76) Inventor: Jung-Fu Chen, No. 10, Lane 2, Yung Hua Rd., Yung An Hsiang Kaohsiung Hsien (TW)

( * ) Notice: Subject to any disclaimer, the term of this patent is extended or adjusted under 35 U.S.C. 154(b) by 0 days.

(21) Appl. No.: 09/207,148

(22) Filed: Dec. 8, 1998

(51) Int. Cl.[7] ..... A61G 10/00
(52) U.S. Cl. ..... 128/206.11; 128/205.27
(58) Field of Search ..... 128/201.17, 205.27, 128/205.29, 206.11, 200.24, 206.18, 205.28; 606/199, 204.45

(56) References Cited

U.S. PATENT DOCUMENTS 2,672,138 * 3/1954 Carlock ..... 128/206.11
4,221,217 * 9/1980 Amezcua ..... 128/206.11
4,327,719 * 5/1982 Childers ..... 128/206.11
5,425,359 * 6/1995 Liou ..... 128/206.11

FOREIGN PATENT DOCUMENTS

393516 * 6/1933 (GB) ..... 128/206.11

* cited by examiner

*Primary Examiner*—Glenn K. Dawson
(74) *Attorney, Agent, or Firm*—Browdy and Neimark

(57) ABSTRACT

A stuff-in type nose plug with air filters is made up a pair of plug units that are integrally connected to each other at one end and has an air filter made of active carbon fixed to the air inlet of each plug unit. Each plug unit made of soft material can be closely engaged with the nostril respectively so as to permit air to be inhaled via each active carbon air filter so that dirt and filthy air can be completely filtered before being inhaled by a person.

2 Claims, 2 Drawing Sheets

STUFF-IN TYPE NOSE PLUG WITH AIR FILTERS

BACKGROUND OF THE INVENTION

The present invention relates to a stuff-in type nose plug with air filters, which is made up a pair of plug units that are integrally connected to each other at one end and has an air filter made of active carbon fixed to the air inlet of each plug unit. Each plug unit made of soft material can be closely engaged with the nostril respectively so as to permit air to be inhaled via each active carbon air filter so that dirt and filthy air can be completely filtered into fresh air before being inhaled by a person.

Air pollution has become a global problem in urban areas all over the world. Exhausted waste from motorcycles and automobiles mainly contribute to the serious problem especially in large cities. Masks have been widely used by people to protect themselves from polluted air. However, a tightly fixed mask makes a wearer subject to heat and sweat in one aspect and a person wearing a mask can not talk naturally and not eat with ease. A mask in practical use can easily spoil make-up especially on lips of a female wearer. Besides, a mask can not be easily fit on the face of a wearer, permitting filthy air to flow into from the periphery thereof.

SUMMARY OF THE INVENTION

Therefore, the primary object of the present invention is to provide for a stuff-in type nose air filter, which is equipped with a pair of integrally, connected hollow plug units substantially in a conic shape. A belt section connects the two conic plug units to each other. The conic plug units are made of soft material so that they can be fitted in nostrils of a person with comfort. A filter made of active carbon is secured to the inlet of each conic plug unit for filtering filthy air. The front tip of each conic tube is made to have a slanted plane opening so that they can be fitted and comfortable in contact with the Nose Bridge of a wearer.

Another object of the present invention is to provide for a stuff-in type nose air filter, which can be retained in the nostrils of a person even when the person is eating, drinking and talking without producing uncomfortable feeling.

DETAILED DESCRIPTION OF THE PREFERRED EMBODIMENT

Figure 1:
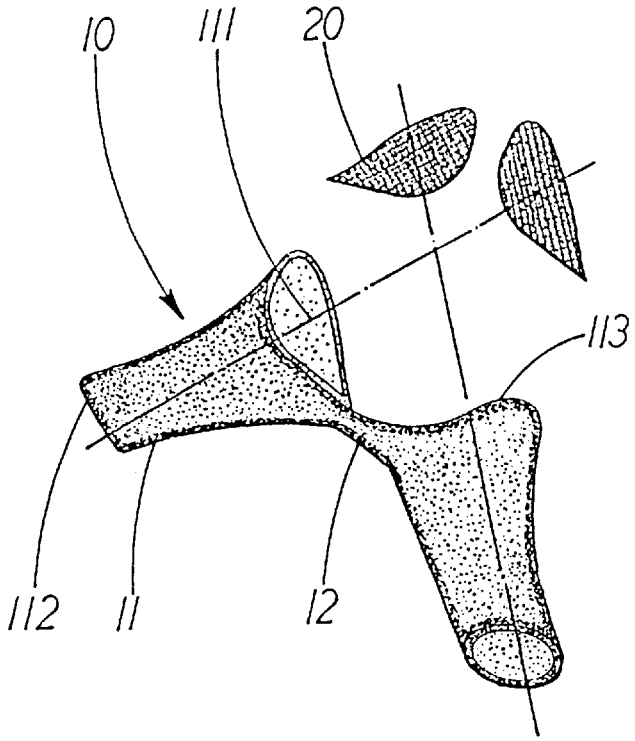
FIG. 1 is a perspective diagram showing the exploded components of stuff-in type nose air filter.
Figure 2:
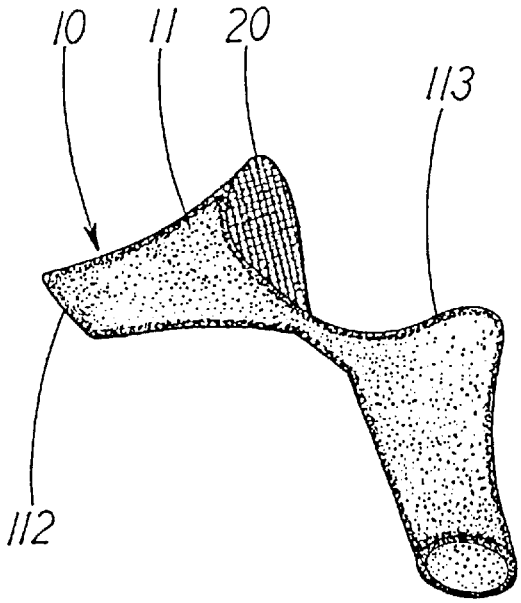
FIG. 2 is a perspective diagram showing the assembly of the present invention.
Figure 3:
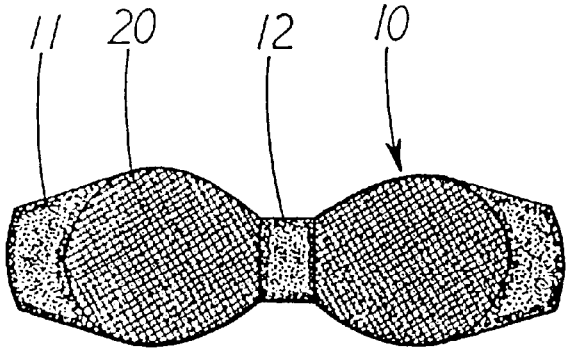
FIG. 3 is a top elevation view of thereof.

Referring to FIGS. 1, 2, the stuff-in nose air filter of the present invention comprises a plug embodiment 10 having a pair of plug units 11 integrally connected to each other at one enlarged end thereof by a belt section 12. Each plug unit 11 of a hollow tube made in substantially conic shape is equipped with an air inlet 111 and outlet 112. Each air inlet 111 has a filter 20 made of active carbon material and in a shape in conformance to the air inlet 111.

Figure 4:
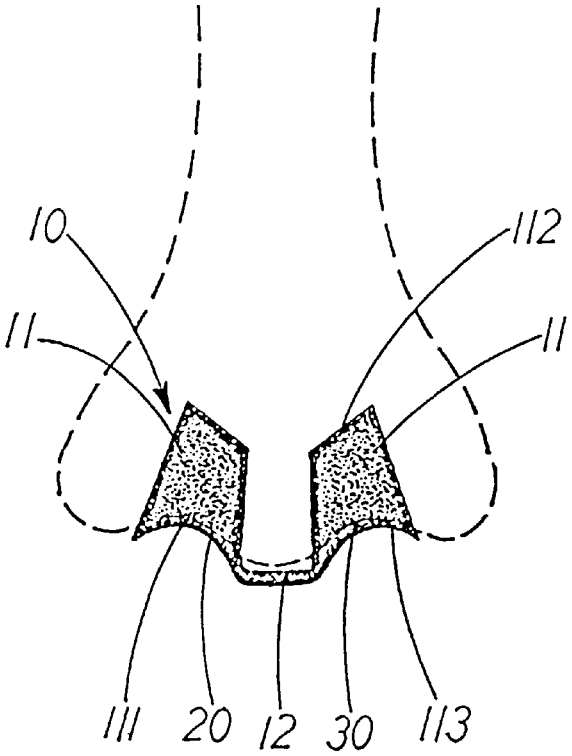
FIG. 4 is a diagram showing the practical application of the stuff-in type nose plug.

As shown in FIG. 4, in the practical application, the plug embodiment 10 is stuffed in the nostrils of a person until each plug unit 11 is completely fitted and retained in the nostrils 30. Each plug unit 11 has its air outlet 112 designed in a slanted plane with respect to its axial direction. Such a slanted air outlet 112 can prevent the uncomfortable pressing of the plug unit 11 against the cartilage of the nose in long term usage.

To make the plug units 11 fit smoothly and engage with nostrils 30 of a wearer and look appealing to eyes, each plug unit 11 is provided with an arc concave contour 113 at the large end thereof in match with the shape of the tip of a nostril. When breathing, air is inhaled via the two air filters 20 made of active carbon and further through the air inlets 111 into the lungs of the wearer. To take the plug embodiment 10 out of the nostrils 30, a person has to only pull the belt section 12 disposed between the plug units 11.

I claim:

1. A stuff-in type nose plug with air filters, comprising:

a plug embodiment having a pair of plug units each substantially having a small end and a large end;

said plug units being connected to each other at each large end by a belt section;

an air inlet being disposed at said large end and an air outlet being disposed at said small end of each said plug unit;

said plug being made of soft material;

an air filter respectively engaged in each said air inlet plug;

wherein said plug units are hollow and have a substantially conic shape with said air outlet disposed on a slanted plane with respect to an axis of each said plug unit;

the axis of each of said plug units intersecting in an angle greater than 45° when not in use and an angle of less than 30° when engaged in a nose of a user;

wherein said air inlet of each plug unit is made to have an arc concave contour to match a shape of a tip of a human nostril; and wherein said air filter is made of active carbon and has a concave shape conforming to said air inlet.

2. The nose plug according to claim 1, wherein said air filter is formed as a sheet.

* * * * *